US009896796B2

(12) United States Patent
Kim et al.

(10) Patent No.: US 9,896,796 B2
(45) Date of Patent: Feb. 20, 2018

(54) LAUNDRY MACHINE AND CONTROL METHOD OF THE SAME

(71) Applicant: LG ELECTRONICS INC., Seoul (KR)

(72) Inventors: Heunggi Kim, Changwon-si (KR); Jaemun Kim, Changwon-si (KR); Kilryong Lee, Changwon-si (KR); Chanwoo Jung, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 19 days.

(21) Appl. No.: 14/019,213

(22) Filed: Sep. 5, 2013

(65) Prior Publication Data

US 2014/0223970 A1 Aug. 14, 2014

(30) Foreign Application Priority Data

Feb. 13, 2013 (KR) ..... 10-2013-0015376
Feb. 13, 2013 (KR) ..... 10-2013-0015377

(51) Int. Cl.
*D06F 39/00* (2006.01)
*D06F 39/04* (2006.01)
(Continued)

(52) U.S. Cl.
CPC ..... *D06F 39/008* (2013.01); *D06F 33/02* (2013.01); *D06F 39/005* (2013.01); *D06F 39/04* (2013.01);
(Continued)

(58) Field of Classification Search
CPC ..... D06F 39/008
See application file for complete search history.

(56) References Cited

U.S. PATENT DOCUMENTS 7,421,865 B2 * 9/2008 Lee ..... D06F 25/00 68/15
7,904,982 B2 * 3/2011 Park ..... D06F 33/02 68/12.02
(Continued)

FOREIGN PATENT DOCUMENTS

CN 101133202 A 2/2008
EP 1275767 A1 1/2003
(Continued)

OTHER PUBLICATIONS

Machine translation of EP2471997.*
Machine translation EP2471997.*

*Primary Examiner* — Michael E Barr
*Assistant Examiner* — Cristi J Tate-Sims
(74) *Attorney, Agent, or Firm* — Dentons US LLP

(57) ABSTRACT

A laundry machine and a control method of the same are disclosed. The disclosed laundry machine includes a tub, a drum rotatably installed in the tub, to receive laundry, a washing heater provided at the tub, to heat wash water, a first wash water passage for supplying the wash water from an external water supply source to the drum via a detergent box, a second wash water passage for supplying the wash water from the external water supply source to an interior of the tub while preventing the wash water from passing through the drum, a course selector for selecting one of a plurality of washing courses, and a controller for selectively opening the first wash water passage or the second wash water passage in accordance with the course selected through the course selector.

18 Claims, 9 Drawing Sheets

(51) Int. Cl.
*D06F 39/08* (2006.01)
*D06F 58/20* (2006.01)
*D06F 33/02* (2006.01)

(52) U.S. Cl.
CPC ..... *D06F 39/088* (2013.01); *D06F 58/203* (2013.01); *D06F 2202/04* (2013.01); *D06F 2202/085* (2013.01); *D06F 2204/04* (2013.01); *D06F 2204/086* (2013.01)

(56) References Cited

U.S. PATENT DOCUMENTS

2006/0191077 A1* 8/2006 Oh et al. ..... 8/158
2006/0191078 A1* 8/2006 Kim ..... D06F 33/02 8/159
2007/0169279 A1* 7/2007 Park ..... D06F 33/02 8/149.3
2008/0134445 A1* 6/2008 Cho ..... D06F 35/006 8/149.1
2008/0250819 A1 10/2008 Park et al.
2008/0256720 A1 10/2008 Park et al.
2008/0276382 A1 11/2008 Benne et al.
2009/0056762 A1* 3/2009 Pinkowski et al. ..... 134/22.15
2009/0078007 A1* 3/2009 Bae ..... D06F 58/04 68/5 C
2009/0083990 A1* 4/2009 Bae ..... D06F 33/02 34/486
2009/0100882 A1 4/2009 Bae et al.
2009/0151084 A1* 6/2009 Lee ..... D06F 35/006 8/149.1
2009/0272155 A1 11/2009 Jeong et al.
2011/0197638 A1* 8/2011 Murrell ..... D06F 39/008 68/5 C
2012/0005918 A1 1/2012 Kim et al.
2013/0291395 A1* 11/2013 Doh ..... F26B 21/086 34/468

FOREIGN PATENT DOCUMENTS

EP 1505193 A2 2/2005
EP 2341176 A1 7/2011
EP 2471997 A1 7/2012
JP 4-242692 8/1992
JP 6-233898 8/1994
JP 2003-326077 A 11/2003
JP 2007-195942 A 8/2007
JP 2008-534048 A 8/2008
JP 2008-264513 A 11/2008
JP 2012-005875 A 1/2012
JP 2012-081352 A 4/2012
JP 2012-161621 A 8/2012
JP 2014-151187 A 8/2014
WO 2006090973 A1 8/2006
WO 2006129912 A1 12/2006
WO WO-2010137910 A2 * 12/2010 ..... D06F 25/00

* cited by examiner

LAUNDRY MACHINE AND CONTROL METHOD OF THE SAME

Pursuant to 35 U.S.C. § 119(a), this application claims the benefit of Korean Patent Application No. 10-2013-0015376, filed on Feb. 13, 2013 and No. 10-2013-0015377, filed on Feb. 13, 2013, which are hereby incorporated by reference as if fully set forth herein.

BACKGROUND OF THE INVENTION

Field of the Invention

The present invention relates to a laundry machine, and, more particularly, to a laundry machine capable of generating steam, to use the steam, and a control method of the same.

Discussion of the Related Art

A laundry machine may include a washer and a dryer. Here, the washer means an apparatus for separating contaminants from laundry, using wash water and detergent. That is, the laundry machine may separate contaminants from laundry by utilizing chemical action of detergent dissolved in wash water and mechanical action of wash water or mechanical action by driving of an inner tub (drum).

The dryer means an apparatus for drying laundry. That is, the dryer dries laundry by supplying hot dry air to the laundry.

Another laundry machine may include a combination washer and dryer capable of not only performing drying, but also performing washing. Similarly to the above-mentioned laundry machine, the combination washer and dryer may perform washing, using wash water and detergent. In this regard, the combination washer and dryer may be referred to as a laundry machine.

One type of laundry machine is a horizontal-axis laundry machine in which a drum receiving laundry is driven with respect to a horizontal axis, to perform washing. In such a horizontal-axis laundry machine, mechanical energy is applied to laundry through driving of the drum, to separate contaminants from the laundry.

The washing environment of the horizontal-axis laundry machine may be an environment in which laundry is partially immersed in water. Accordingly, most mechanical actions to wash laundry in the horizontal-axis laundry machine may include friction among clothes of laundry, friction between the laundry and the drum, impact force applied to the laundry, etc. Of course, in this case, washing may be carried out through chemical action of a detergent.

Another type of laundry machine is a vertical-axis laundry machine in which an inner tub receiving laundry rotates with respect to a vertical axis, or a pulsator installed in the inner tub rotates, to perform washing. In such a vertical-axis laundry machine, mechanical energy is applied to laundry through driving of the inner tub or pulsator, to separate contaminants from the laundry, as in the above-mentioned horizontal-axis laundry machine.

The washing environment of the vertical-axis laundry machine may be an environment in which laundry is partially immersed in water. Accordingly, most mechanical actions to wash laundry in the vertical-axis laundry machine may include friction between the laundry and the flow of water, impact force applied to the laundry, etc. Of course, in this case, washing may also be carried out through chemical action of a detergent.

Thus, the vertical-axis laundry machine and horizontal-axis laundry machine have a great difference in terms of amount of wash water used in washing and washing mechanism.

In spite of such a difference, both the horizontal-axis laundry machine and the vertical-axis laundry machine may include a washing heater for heating wash water. Heating of wash water may be carried out for promoted activation of detergent to obtain enhanced washing effects and for enhanced sterilization effects at high temperature. Therefore, generally, the temperature of wash water may be increased to a predetermined temperature through driving of the washing heater. That is, generally, washing effects may be enhanced through an increase in the temperature of wash water.

Recently, a laundry machine, in which steam is supplied to create a high-temperature washing environment while reducing energy consumption, has come into wide use. In such a laundry machine, steam is generated and supplied to a drum in order to create a hot and humid washing environment for enhanced washing effects. This laundry machine may obtain enhanced washing effects through a steam washing course using steam in addition to water washing.

In such a laundry machine, however, there are increased costs and control difficulty because a separate steam generator should be employed. In detail, the steam generator includes a steam heater for generating steam, separately from a general washing heater. For this reason, use of a laundry machine, which employs a washing heater while excluding a separate steam generator, has been proposed.

Steam may be generated through heating of water to the boiling point of water or above. In this regard, a laundry machine equipped with a separate steam generator may be a laundry machine in which water is heated to the boiling point thereof or above, to generate steam, and the generated steam is used for washing. Steam may also be generated through heating of water to a temperature lower than the boiling point of water. In this regard, a laundry machine, which employs a washing heater while excluding a separate steam generator, may be a laundry machine in which water is heated to a temperature lower than the boiling point thereof, to generate steam, and the generated steam is used for washing.

In the laundry machine, which generates steam, using the washing heater, steam is generated within the tub. That is, steam may be generated in a relatively large space. Therefore, generally, steam may be generated through heating of water to a temperature lower than the boiling point of water by the washing heater.

In the laundry machine, which generates steam, using the washing heater, steam is mainly used during water washing due to structural restriction.

Steam may be used to obtain enhanced washing effects in water washing. Steam may also be used to refresh laundry. In particular, in a laundry machine such as a dryer, a refreshing course may be provided.

In a dryer, steam may be mainly used to refresh laundry, for example, to remove creases or odor, rather than for enhancement in washing effects.

Hereinafter, a conventional general laundry machine will be described with reference to FIGS. 1 and 2.

The laundry machine may include a cabinet 10 to form an appearance of the laundry machine, and a tub 20 installed in the cabinet 10. The tub 20 may be configured to receive wash water.

The tub 20 may be provided with a washing heater 60 for heating wash water. Due to gravity, the water level of wash water supplied to the tub 20 may be gradually increased from a bottom surface of the tub 20. Accordingly, the washing heater 60 may be arranged at a lowest portion of the tub 20.

A drum 30 is disposed within the tub 20. The drum 30 is rotatably installed in the tub 20. Laundry is received in the drum 30. The drum 30 may be driven by a driving unit 71-72. Through driving of the drum 30, washing may be carried out.

The driving unit may include a motor 71. Driving of the motor 71 may be directly converted into driving of the drum 30. Such a structure is generally referred to as a "direct connection type motor structure. Of course, rotation of the motor 71 may be converted into driving of the drum 30 via a pulley 72, as illustrated in the drawings.

Due to driving of the drum 30, etc., vibration may be transmitted to the tub 20. To this end, the tub 20 may be supported with respect to the cabinet 10 by dampers 21.

A door 40 may be provided in front of the drum 30. A gasket 50 may be provided in rear of the door 40. The gasket 50 may be connected to the cabinet 10 and tub 20. Accordingly, the front side of the tub 20 may be elastically supported with respect to the cabinet 10 by the gasket 50.

For execution of washing, wash water should first be supplied. To this end, a water supply unit 80 is provided to supply wash water from an external water supply source to the laundry machine.

The water supply unit 80 may include a water supply valve 81, which is selectively opened or closed, and a wash water passage 82. The wash water passage 82 may be connected with a detergent box 83 for receiving detergent. The detergent box 83 may be supplied to a supply passage 84. Wash water and detergent supplied through the supply passage 84 may be mainly supplied to the interior of the drum 30.

As illustrated in FIG. 2, a plurality of through holes 31 is provided at the drum 30. The interior of the drum 30 may communicate with the interior of the tub 20 through the through holes 31.

A heater mounting recess 22 may be formed at a lower portion of the tub 20. The heater mounting recess 22 may be provided at a lowermost portion of the tub 20. Since the washing heater 60 is mounted in the heater mounting recess 22, it may remain immersed in water even at a lowest level of wash water.

The heater mounting recess 22 may be connected to a drainage passage 23. Accordingly, wash water in the tub 20 may be drained outwards of the laundry machine via the heater mounting recess 22 and drainage passage 23.

As mentioned above, generally, generation of steam using the washing heater 60 requires water washing as a precondition thereof. This may also be seen from the structural features of the laundry machine illustrated in FIGS. 1 and 2.

In detail, wash water and detergent for washing are supplied to the interior of the drum 30. That is, when supply of water is executed, the supplied wash water and detergent wet laundry received in the drum 30. The wash water and detergent is partially collected in the tub 20, starting from the bottom of the tub 20.

As supply of water continues, the level of wash water is gradually increased. Supply of water continues until the level of wash water reaches a predetermined water level.

In particular, the predetermined water level in the horizontal-axis laundry machine is relatively lower than that of the vertical-axis laundry machine. In other words, in the horizontal-axis laundry machine, washing is carried out in an environment in which laundry is partially immersed in water. Therefore, the structure in which wash water and detergent are directly supplied to laundry may be general.

In order to generate steam, using the washing heater, accordingly, there may be a problem in that water should always be supplied through the interior of the drum. That is, there may be a problem in that supply of wash water inevitably involves wetting of at least a portion of the laundry received in the drum.

For this reason, there is difficulty in variously utilizing steam because utilization of steam requires water washing as a precondition thereof. In detail, there are many problems in utilizing steam only for refreshing. This is because laundry to be refreshed has a very high moisture content due to the above-mentioned structural problem and, as such, a separate drying procedure should be needed.

Meanwhile, the level of refreshing in conventional laundry machines is about a level of simply supplying moisture to laundry, using steam. That is, refreshing in conventional laundry machines only involves tumbling in the drum in order to uniformly supply steam to all laundry. Therefore, it is necessary to provide a scheme capable of deriving optimal relations among the steam generation and supply structure, the temperature of steam, and driving of the drum, to enable execution of more effective refreshing.

In addition, it is necessary to provide a laundry machine capable of performing refreshing while reducing a subsequent drying procedure as much as possible. That is, it is necessary to provide a laundry machine capable of realizing a refreshing performance enabling wearing of clothes just after refreshing thereof without requiring drying through a dryer or natural drying.

SUMMARY OF THE INVENTION

Accordingly, the present invention is directed to a laundry machine and a control method of the same that substantially obviate one or more problems due to limitations and disadvantages of the related art.

An object of the present invention is to provide a laundry machine capable of supplying wash water at an optimal position in accordance with a selected course, through control of varying the supply position of wash water in accordance with a selected course, and a control method of the same.

Another object of the present invention is to provide a laundry machine capable of achieving refresh, using steam, while obtaining enhanced washing effects, using steam, and a control method of the same.

Another object of the present invention is to provide a laundry machine capable of achieving effective generation and supply of steam, using a washing heater, and a control method of the same.

Another object of the present invention is to provide a laundry machine capable of executing a wash water heating operation, separately from a steam operation, using a washing heater, and a control method of the same.

Another object of the present invention is to provide a laundry machine capable of more effectively achieving forced cooling through supply of wash water, and a control method of the same.

An object of the present invention is to provide a laundry machine capable of remarkably enhancing crease removal effects and odor removal effects, and a control method of the same.

Another object of the present invention is to provide a laundry machine capable of achieving enhanced safety and enhanced reliability, and a control method of the same.

Another object of the present invention is to provide a laundry machine capable of realizing a refreshing performance enabling wearing of garments just after refreshing thereof without requiring a separate drying procedure, and a control method of the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a tub, a drum rotatably installed in the tub, to receive laundry, a washing heater provided at the tub, to heat wash water, a first wash water passage for supplying the wash water from an external water supply source to the drum, e.g. via a detergent box, a second wash water passage for supplying the wash water from the external water supply source to an interior of the tub while preventing the wash water from passing through the drum, and a controller for selectively opening the first wash water passage or the second wash water passage in accordance with the course selected by a user, e.g. using a course selector for selecting one of a plurality of washing courses. The washing heater may be arranged at a lower portion of the tub, inside or outside thereof. Also, the tub may include a recess at a bottom portion thereof in which the heater is arranged. The first wash water passage may be configured to supply wash water for wetting the laundry, e.g. in a washing course including a water washing operation. The second wash water passage may be configured to supply water for generating steam or for cooling, e.g. in a washing course including a steaming operation or a cooling operation, a refreshing course excluding water washing and the like. Thus, the second wash water passage is preferably used, if the laundry should not get wet. Moreover, the second wash water passage is preferably configured to supply fresh water to the tub, i.e. without passing a detergent box or the like. Preferably, fresh water is used for the steaming operation, so that steam is generated using fresh water supplied via the second wash water passage, i.e. without detergent. Also for the cooling operation, preferably fresh water is used, supplied via the second wash water passage. By these means, detergent deposition at the wash heater during steam generation or during a cooling operation can be avoided, thus increasing the operability of the laundry machine.

The laundry machine may further include a first water supply valve for opening or closing the first wash water passage, and a second water supply valve for opening or closing the second wash water passage. The first water supply valve and the second water supply valve may be separate from each other. In other words, the first and second wash water passages may supply wash water to different positions, respectively. Of course, the first and second wash water passages may supply wash water from the same external water supply source. Alternatively, a multiple-way valve or directional control valve may be used, such as a 3-way valve.

The second wash water passage may be a passage formed between the tub and the drum, to supply wash water to the tub. That is, the wash water may be supplied to the tub via a space between the tub and the drum. In detail, the wash water may be supplied to a lower portion of the tub along an inner surface of the tub, but outside of the drum.

The laundry machine may further include a water supply port provided at a top portion of the tub and connected to the second wash water passage. Preferably, a rear water supply port at a rear top portion of the tub is provided. This rear water supply port may be located at a circumferential surface of the tub close to a rear end thereof. The second wash water passage may include the water supply port. Accordingly, it may be possible to achieve effective cooling during falling of the wash water in the tub, i.e. by the water flowing along an inner surface of the tub to a lower portion thereof.

In more detail, the rear water supply port may be formed to allow the wash water to be supplied from an outside of the drum to a lower portion of the tub along an inner rear surface of the tub. Accordingly, an increased heat transfer area is provided to achieve more effective cooling.

The plurality of washing courses may include a washing course in which a steaming operation is executed, as a steam course, and a washing course in which execution of the steaming operation is excluded, as a steam-excluding course.

The controller may execute a control operation to supply the wash water to the interior of the tub via the first wash water passage, or via the first water supply valve, when the steam-excluding course is selected.

The controller may execute a control operation to supply the wash water to the interior of the tub via the second wash water passage, or via the second water supply valve, when the steam course is selected.

The steam-excluding course may include a main washing operation for executing water washing by the wash water.

The steam course may include a steam washing course including a steaming operation and a main washing operation for executing water washing by the wash water, and a refreshing course including a steaming operation while excluding the main washing operation, to refresh the laundry by steam. In other words, the plurality of washing courses may include courses, in which water washing is applied without using steam, and/or courses, in which water washing and steam supply is performed, and/or courses, in which the laundry is not wetted by wash water.

The controller may execute a control operation to supply the wash water to the interior of the tub via the second wash water passage, or via the second water supply valve, when the refreshing course is selected.

The controller may execute a control operation to supply the wash water to an interior of the drum via the first wash water passage, or via the first water supply valve, for execution of the steaming operation of the steam washing course. The controller may execute a control operation to supply the wash water to the interior of the tub via the second wash water passage, or via the second water supply valve, for execution of the steaming operation of the refreshing course. That is, it may be possible to change the wash water supply passage in accordance with the selected course.

The steaming operation may be an operation of supplying steam to an interior of the drum. This may be achieved by driving the washing heater at a predetermined water level for generation of steam which is lower than a bottom of the drum. That is, the steaming operation may be an operation of driving the washing heater while preventing the laundry in the drum from coming into contact with the wash water, i.e. under the condition that the laundry does not contact the wash water. Generally, when using the second wash water passage, e.g. for a cooling or steaming operation, water is preferably supplied up to a bottom of the drum at most.

The predetermined water level for generation of steam may be a water level at which the washing heater is completely immersed in water.

The driving of the washing heater in the steaming operation may be continuously executed for a variable time, and an allowable maximum value of the variable time may be predetermined, taking into consideration a capacity of the washing heater and an amount of the wash water at the water level for generation of steam.

The steaming operation may include a temperature control operation of continuously driving the washing heater until a heating temperature of the washing heater reaches a predetermined temperature, and a time control operation of continuously driving the washing heater for a predetermined time after completion of the temperature control operation.

The predetermined temperature in the temperature control operation may be approximately 93 to approximately 97° C. In detail, the predetermined temperature may be approximately 95° C.

The refreshing course may include the steaming operation, which is executed to supply steam to the interior of the drum by heating the wash water after completion of the supply of the wash water, and a refreshing operation of refreshing the laundry by driving the drum after completion of the steaming operation. The controller may control the steaming operation and the refreshing operation to be sequentially executed when the refreshing course is selected.

The controller may control the refreshing operation to be executed for a predetermined time.

The controller may control the refreshing operation to alternately execute a tumbling driving operation of the drum and a spin driving operation (filtration driving operation) of the drum.

The controller may control the refreshing operation to repeat multiple times a drum driving cycle including the tumbling driving operation and the spin driving operation.

The time taken for the tumbling driving operation may be 10 times or more as long as the time taken for the spin driving operation.

The controller may execute a control operation to supply the wash water to the interior of the tub up to a predetermined water level for re-supply of water via the second wash water passage, or via the second water supply valve, after completion of the refreshing operation.

The water level for re-supply of water may be higher than a water level for generation of steam, and/or lower than a bottom of the drum.

The controller may control the drum to execute the tumbling driving operation in the steaming operation.

In another aspect of the present invention, a method is provided for controlling a laundry machine according to any one of the above described examples to execute a refreshing course for removal or reduction of creases formed at laundry through supply of steam to the laundry. The method may include a steam water supply operation of supplying wash water from an external water supply source to an interior of a tub up to a water level for generation of steam while preventing the wash water to pass through a drum, a steaming operation of heating the wash water by driving a washing heater provided at the tub, thereby generating steam from the wash water at the water level for generation steam, and a refreshing operation of refreshing the laundry. The washing heater is preferably arranged at the bottom of the tub, i.e. outside or inside thereof. The method may further include a course selection operation of selecting one of a plurality of washing courses, wherein the steam water supply operation is performed, when the refreshing course is selected in the course selection operation. Moreover, the refreshing operation may include alternately executing, after execution of the steaming operation, a tumbling driving operation to tumble the laundry within the drum in accordance with rotation of the drum and a spin driving operation to rotate the laundry within the drum in close contact with an inner surface of the drum, together with the drum, in accordance with high-speed rotation of the drum. Preferably, the tumbling driving operation and the spin driving operation are repeatedly executed. Tumbling driving may be defined as driving of the drum causing laundry within the drum to fall in accordance with rotation of the drum. Spin driving may be defined as driving of the drum causing laundry within the drum to rotate together with the drum while in close contact with an inner surface of the drum in accordance with high-speed rotation of the drum. In this regard, the rotation speed of the drum during spin driving should be higher than the rotation speed of the drum during tumbling driving.

The plurality of washing courses may include a water washing course of executing water washing by supplying the wash water up to a water level for main washing. The water washing course may include a heating executable course in which a heating operation is executed after supply of the wash water up to the water level for main washing, and a heating-excluding course in which the heating operation is excluded.

The water level for main washing may be always higher than the water level for generation of steam, irrespective of an amount of laundry and selection of the water washing course.

The supply of the wash water up to the water level for main washing may be executed such that the wash water is supplied from the external water supply source to an interior of the drum via a detergent box.

The supply of wash water up to the water level for generation of steam may be executed via a rear water supply port provided at a rear top portion of the tub.

The driving of the washing heater in the steaming operation may be continuously executed for a variable time, and an allowable maximum value of the variable time may be predetermined, taking into consideration a capacity of the washing heater and an amount of the wash water at the water level for generation of steam.

The steaming operation may include a temperature control operation of continuously driving the washing heater until a heating temperature of the washing heater reaches a predetermined temperature, and a time control operation of continuously driving the washing heater for a predetermined time after completion of the temperature control operation. The predetermined time of the time control operation may be an allowable maximum value. That is, the predetermined time may be an allowable maximum time.

Accordingly, as the time taken for the temperature control operation increases, the time taken for the time control operation may be decreased because the allowable maximum value of the steaming operation is predetermined.

The predetermined temperature in the temperature control operation may be 93 to 97° C. In detail, the predetermined temperature may be 95° C.

The refreshing operation is executed for a predetermined time.

In the refreshing operation, a drum driving cycle including the tumbling driving operation and the spin driving operation may be repeated multiple times.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First, an example of a laundry machine applicable to an embodiment of the present invention will be described in detail with reference to FIGS. 3 and 4. The laundry machine illustrated in FIGS. 3 and 4 may be a horizontal-axis laundry machine. Of course, the laundry machine according to the embodiment of the present invention and a control method of the same are not limited to the horizontal-axis laundry machine.

Figure 1:
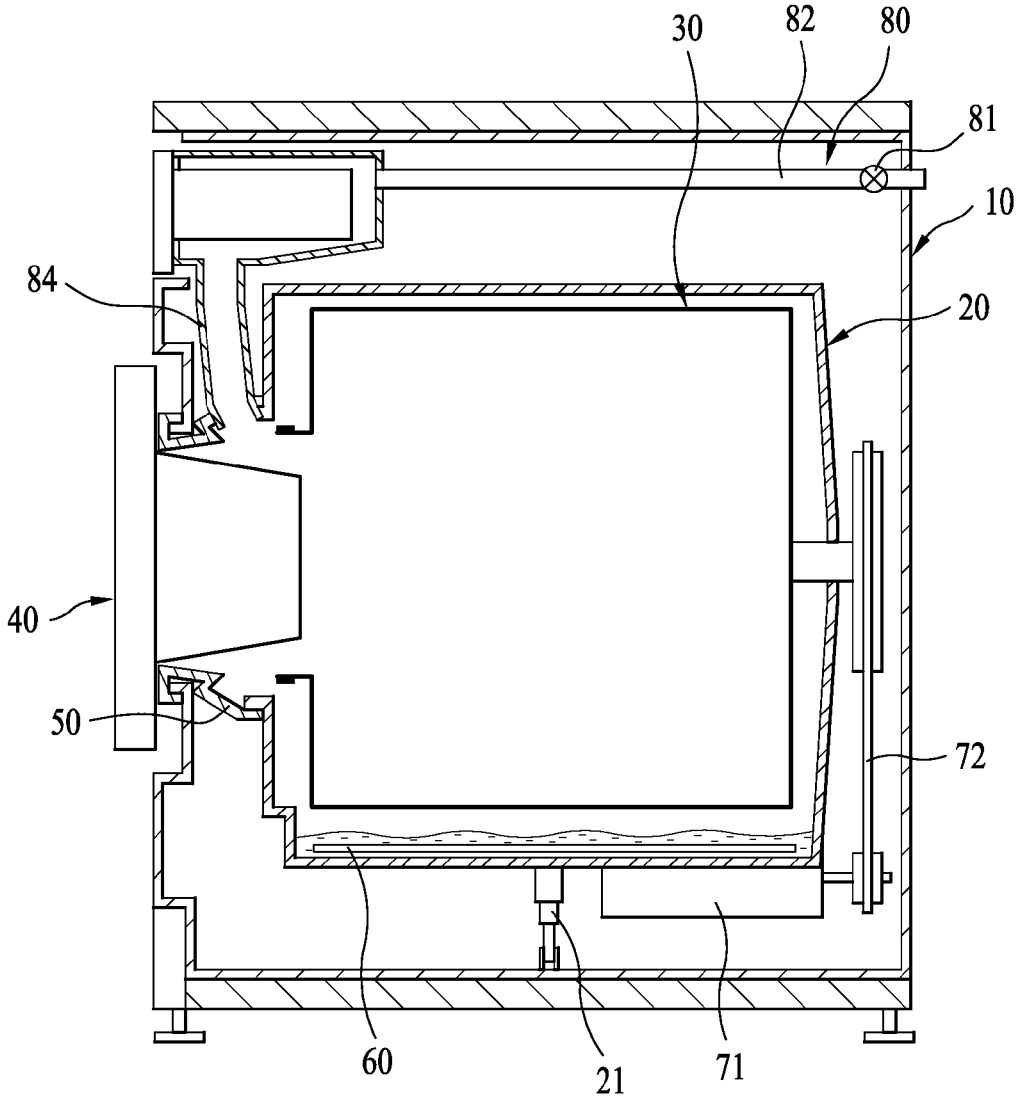
FIG. 1 is a lateral sectional view schematically illustrating a general laundry machine.
Figure 2:
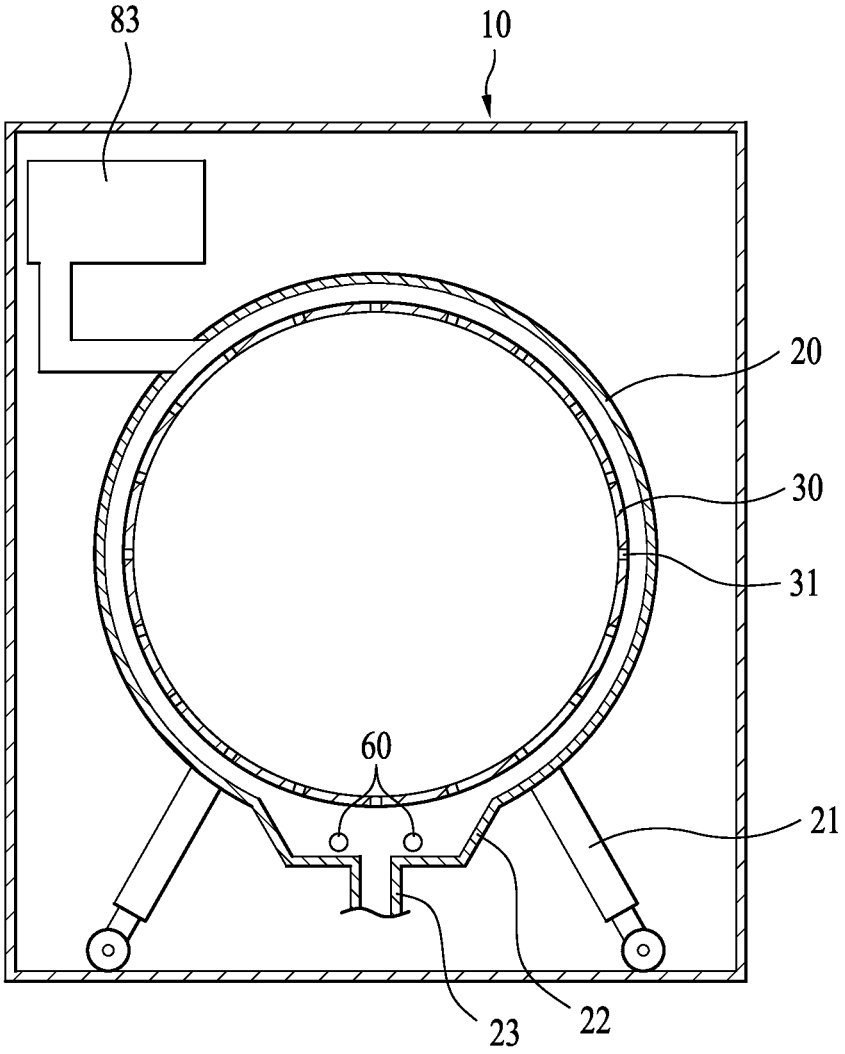
FIG. 2 is a front sectional view schematically illustrating the laundry machine illustrated in FIG. 1.
Figure 3:
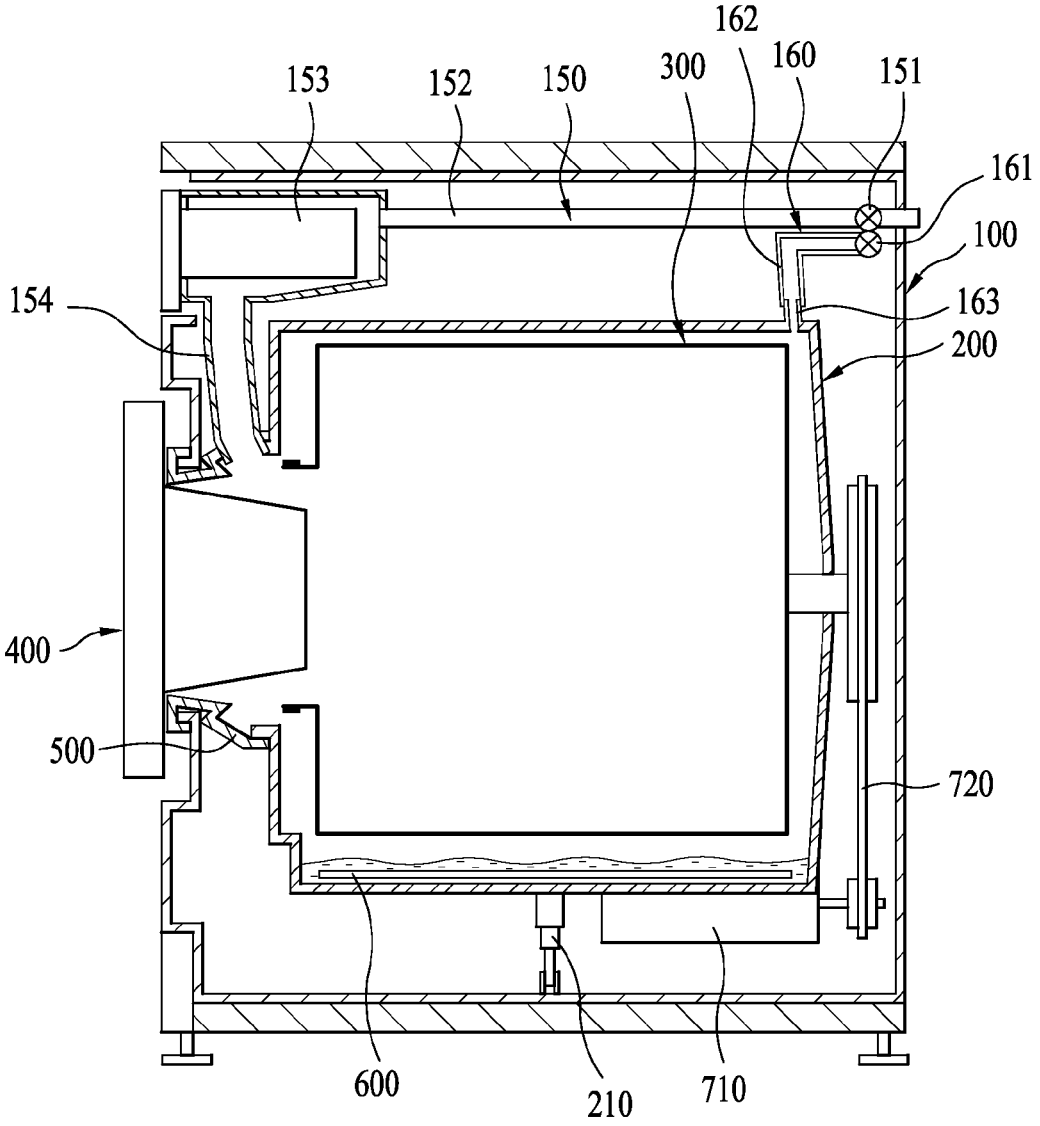
FIG. 3 is a lateral sectional view schematically illustrating a laundry machine according to an exemplary embodiment of the present invention.
Figure 4:
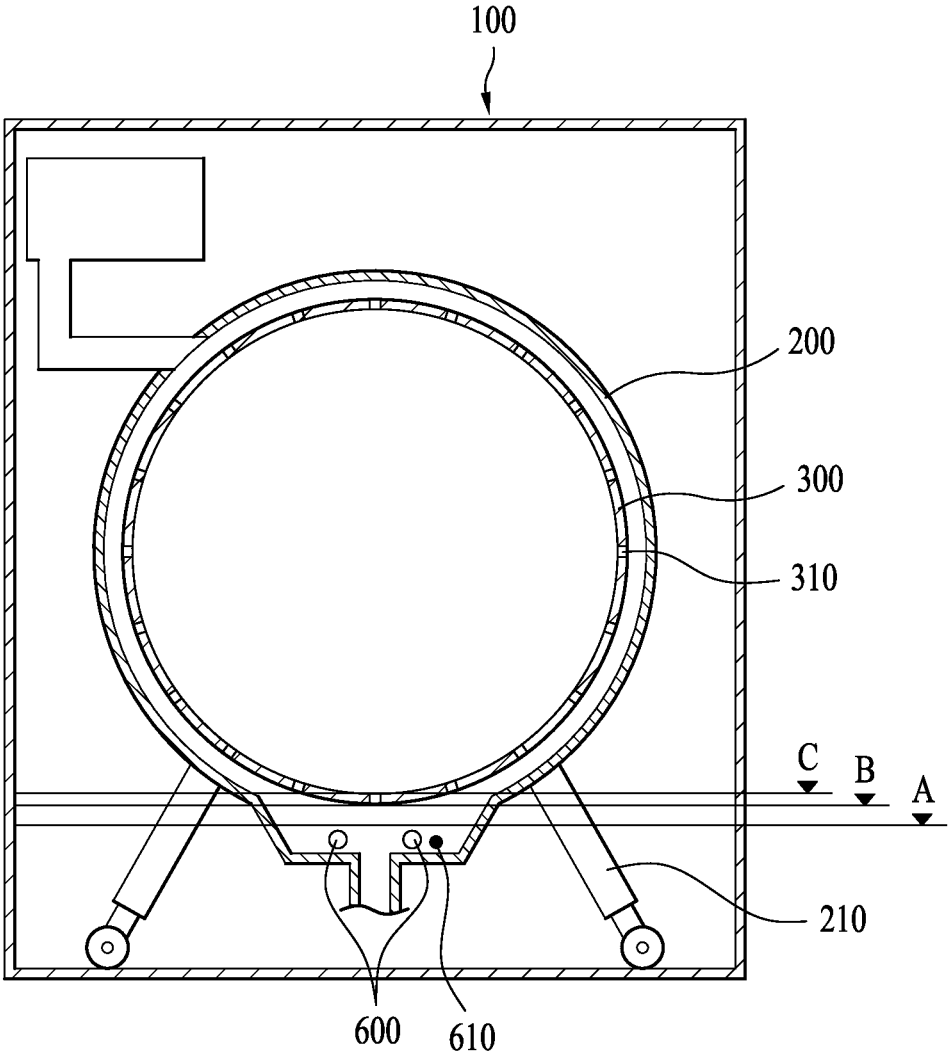
FIG. 4 is a front sectional view schematically illustrating the laundry machine illustrated in FIG. 3.

As illustrated in FIGS. 3 and 4, the basic configurations of the laundry machine according to the illustrated embodiment may be similar to those of a conventional general laundry machine. Basically, configurations such as a cabinet 100, a tub 200, a drum 300, a door 400, a gasket 500, a washing heater 600, and a driving unit 710-720 may be similar to those of a conventional general laundry machine.

Suspension structures such as dampers 210 in the laundry machine according to the illustrated embodiment may be similar to those of the conventional general laundry machine.

However, the laundry machine according to the illustrated embodiment may include a first wash water passage 150 and a second wash water passage 160. The first wash water passage 150 and second wash water passage 160 may be separate from each other.

Both the first wash water passage 150 and the second wash water passage 160 may receive wash water from an external water supply source. The laundry machine may receive wash water from the external water supply source via an external hose connected to the external water supply source. Thus, wash water supplied from an outside of the laundry machine may reach desired positions within the laundry machine via different passages, respectively.

In detail, the first wash water passage 150 and second wash water passage 160 may communicate with the tub 200. Accordingly, although wash water is supplied through different supply passages, the wash water may be collected in the tub 200, starting from a bottom of the tub 200. Due to the different supply passages, however, there may be differences as follows.

The first wash water passage 150 may be provided to supply wash water from the external water supply source to the drum 300 via a detergent box 153. For such a function, the first wash water passage 150 may include a first water supply valve 151. The first wash water passage 150 may also include a first water supply hose 152 to communicate the first water supply valve 151 and detergent box 153.

The first water supply valve 151 is selectively opened or closed. Accordingly, when the first water supply valve 151 is opened, the first wash water passage 150 may be opened. Thus, when the first water supply valve 151 is opened, wash water is supplied via the first wash water passage 150.

In addition, the first wash water passage 150 may include a first supply hose 154 to communicate the detergent box 153 and the interior of the drum 300. The first supply hose 154 may extend through the gasket 500. Accordingly, wash water may be directly supplied to the interior of the drum 300 via the first water supply hose 154. The first water supply hose 154 is arranged above the door 400 and, as such, wash water falls onto laundry received in a lower portion of the drum 300. Accordingly, wash water supplied via the first supply hose 154 wets at least a portion of the laundry received in the drum 300.

The wash water supplied to the interior of the drum 300 may be introduced into a lower portion of the tub 200 via through holes 310 of the drum 300 illustrated in FIG. 4.

In this regard, the first wash water passage 150 may be a passage for supplying wash water from the external water supply source to the drum 300, in detail, an upper portion of the drum 300, via the detergent box 153. Of course, the first wash water passage 150 may include a passage for supplying wash water from the interior of the drum 300 to the lower portion of the tub 200 via the through holes 310 of the drum 300.

By virtue of provision of the first wash water passage 150, laundry is wetted from an early stage of water supply. Accordingly, it may be possible to expect reduced washing time and enhanced washing effects through rapid wetting of laundry.

In the illustrated embodiment, the second wash water passage 160 may be separate from the first wash water passage 150. That is, it is desirable to provide parallel wash water passages which supply wash water through different paths, respectively.

In detail, the second wash water passage 160 may be provided to directly supply wash water from the external water supply source to the interior of the tub 200 while preventing the wash water from passing through the drum 300.

The second wash water passage 160 may include a second water supply valve 161. The second water supply valve 161 is selectively openable. Accordingly, when the second water supply valve 161 is opened, the second wash water passage 160 may be opened to supply wash water.

The second water supply valve 161 may be separate from the first water supply valve 151. Accordingly, the first and second water supply valves 151 and 161 may be controlled independently of each other. This means that the valves 151 and 161 are simultaneously openable or only a selected one of the valves 151 and 161 is openable. That is, the first and second wash water passages 150 and 160 may be selectively opened.

In addition, the second wash water passage 160 may include a second supply hose 162. The second supply hose 162 is connected to the second water supply valve 161 and, as such, supplies wash water to the tub 200 when the second water supply valve 161 is opened.

In this case, the position at which the second supply hose 162 communicates with the tub 200 is different from the position at which the first supply hose 154 communicates with the tub 200 or drum 300. In other words, the first and second supply hoses 154 and 162 may have different wash water supply positions, respectively.

In detail, the second supply hose 162 may directly communicate with the tub 200 in order to prevent wash water from entering the drum 200. In other words, wash water supplied through the second supply hose 162 may be prevented from coming into contact with laundry received in the drum 300.

In more detail, the second supply hose 162 may communicate with a rear water supply port 163. Accordingly, the second wash water passage 160 may supply wash water to the interior of the tub 200 through the rear water supply port 163.

As illustrated in FIG. 3, the rear water supply port 163 may be disposed at a rear portion of the tub 200. In detail, the rear water supply port 163 may be disposed at a top side of the rear portion of the tub 200. Preferably, the rear water supply port 163 is disposed in rear of the rearmost portion of the drum 300.

Accordingly, wash water supplied through the rear water supply port 163 is introduced into the tub 200 at the outside of the drum 300. The introduced wash water may be collected in the lower portion of the tub 200. In accordance with the position of the rear water supply port 163, wash water supplied via the second wash water passage 160 may be supplied to the interior of the tub 200 without wetting laundry.

Meanwhile, the position and shape of the rear water supply port 163 may be determined such that the rear water supply port 163 corresponds to a rear surface of the tub 200. In other words, wash water supplied through the rear water supply port 163 may be directed to the rear surface of the tub 200. To this end, the rear water supply port 163 may be arranged at a position just above the rear surface of the tub 200.

The rear water supply port 163 may also be formed to be inclined. That is, the rear water supply port 163 may be inclined rearwards. Accordingly, wash water supplied through the rear water supply port 163 may flow to the lower portion of the tub 200 along the rear surface of the tub 200.

The rear water supply port 163 may be disposed at a more rear position of the tub 200, as compared to the position illustrated in FIG. 3. The rear water supply port 163 may also be further inclined, as compared to the case illustrated in FIG. 3.

The position and wash water supply direction of the rear water supply port 163 may be determined to achieve various goals and effects in addition to the above-described goals and effects. This will be described later.

Figure 5:
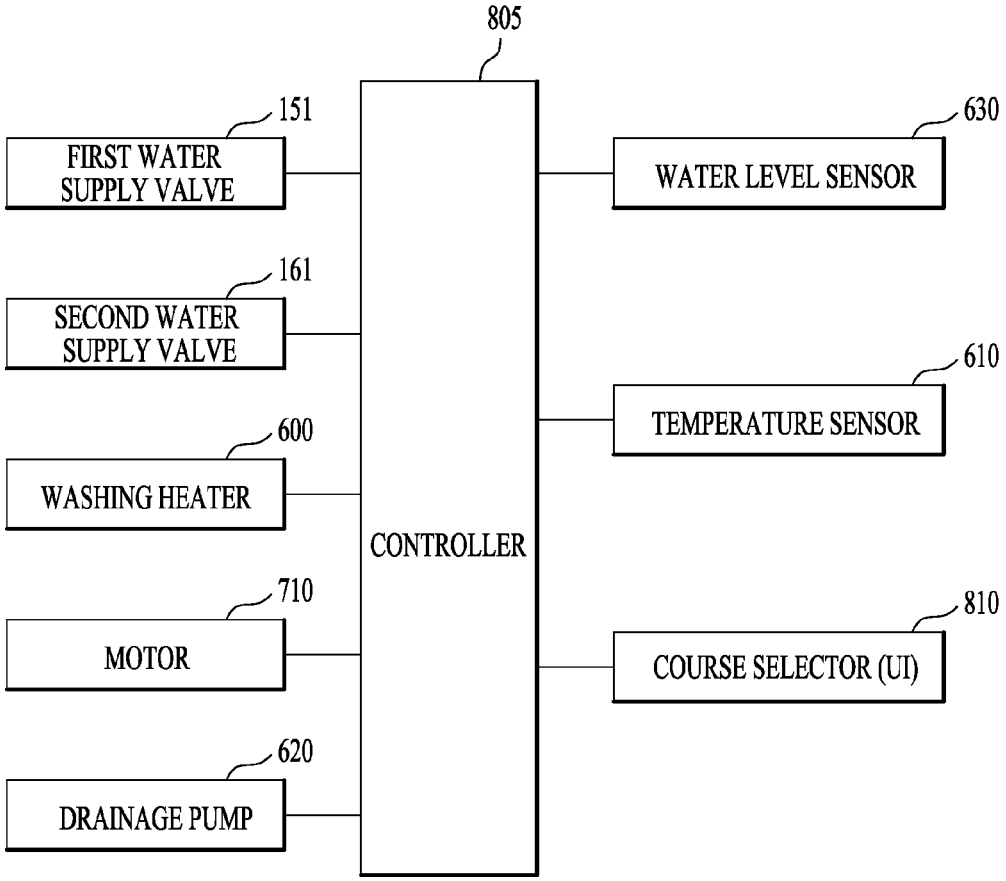
FIG. 5 is a block diagram schematically illustrating a configuration of the laundry machine according to an exemplary embodiment of the present invention.

FIG. 5 is a block diagram of the laundry machine according to the illustrated embodiment.

Figure 6:
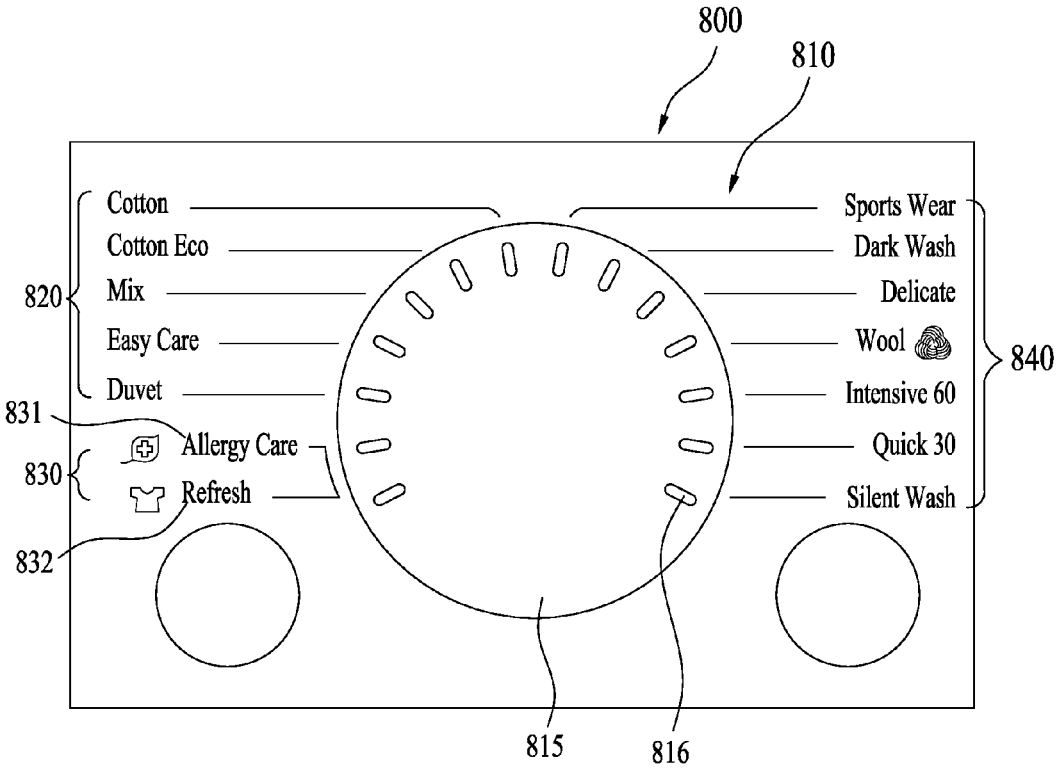
FIG. 6 is a front view illustrating an example of a control panel included in the laundry machine in accordance with an exemplary embodiment of the present invention.

Operation of the laundry machine is controlled through a controller 805. Generally, the controller 805 may be provided within a control panel 800 (FIG. 6). Generally, the control panel 800 is disposed on a top of the laundry machine, to allow the user to manipulate the control panel 800 and display of status.

The controller 805 may control operation of the laundry machine, based on signals input through various user interfaces (UIs), for example, a course selector 810 or the like provided at the control panel 800. That is, the laundry machine is operated in accordance with a course selected through the course selector 810 and an option selected through an option selector that is not shown.

Information as to the selected course and option, time information, and current status information may be displayed on a display not shown, under control of the controller 805.

The controller 805 may control driving of the first and second water supply valves 151 and 161. Through control of the first and second water supply valves 151 and 161, it may be possible to control an amount of wash water supplied. The controller 805 may also control a wash water supply position such that the wash water supply position is varied, through control of the water supply valves 151 and 161 as described above.

The controller 805 may control driving of the washing heater 600. Accordingly, the washing heater 600 may be driven such that the temperature of wash water reaches a desire temperature. The washing heater 600 may also be prevented from overheating.

The controller 805 may control driving of a motor 710 of the driving unit. Through control of the motor 710, it may be possible to appropriately determine a time when the motor 710 is to be driven and a driving pattern of the motor 710 (for example, tumbling driving of the drum 300, spin driving of the drum 300, spin-drying driving of the drum 300, etc.).

Tumbling driving means driving of the drum causing laundry within the drum to tumble in accordance with rotation of the drum. Spin driving means driving of the drum causing laundry within the drum to rotate together with the drum while in close contact with an inner surface of the drum in accordance with high-speed rotation of the drum. In this regard, the rotation speed of the drum during spin driving should be higher than the rotation speed of the drum during tumbling driving.

Spin-drying driving is similar to spin driving. However, the rotation speed of the drum during spin-drying driving may be higher than the rotation speed of the drum during spin driving. This is because spin-drying driving is driving for removal of moisture through centrifugal force.

The controller 805 may control driving of a drainage pump 620. Accordingly, drainage may be executed at a time when drainage is needed.

The controller 805 is always signal-connected with a water level sensor 630 and a temperature sensor 610. Accordingly, the controller 805 may receive desired water level information and temperature information at a specific time through the sensors 610 and 630.

Based on water level information supplied from the water level sensor 630, the controller 805 may control driving of the water supply valves 151 and 161. Accordingly, it may be possible to supply wash water to a desired water level.

Based on temperature information supplied from the temperature sensor 610, the controller 805 may control driving of the washing heater 600. Accordingly, it may be possible to heat wash water to a desired temperature.

FIG. 5 illustrates an example of the control panel 800 in the laundry machine according to the illustrated embodiment.

The laundry machine may selectively execute a plurality of washing courses in order to wash various articles of laundry. The laundry machine may also selectively execute a plurality of washing courses in order to provide functionality in addition to washing of laundry. In this regard, it is desirable to enable the user to easily select a desired one of the plural washing courses.

The laundry machine according to the illustrated embodiment may include the washing heater 600 which heats wash water, as described above. The washing heater 600 may also generate steam. The steam may be supplied to the interior of the drum 300. In detail, steam generated at the lower portion of the tub may be supplied to the interior of the drum 300 through the through holes 310 of the drum 300.

Steam generation through the washing heater 600 involves additional energy consumption. Therefore, it is desirable to enable the user to clearly check whether or not steam is used. To this end, in the illustrated embodiment, various courses associated with steam may be provided.

The course selector 810 may be provided for selection of a specific course from among plural courses.

The plural courses may include heating executable courses 820. That is, the plural courses may include courses in which the washing heater 600 may be driven. When the user selects one of the heating executable courses 820, the selected course may be executed. In this case, the controller 805 may control the laundry machine to execute the selected course in accordance with a predetermined program.

For example, the heating executable courses 820 may include a normal course. When the user only selects the normal course, the normal course which includes washing, rinsing and spin-drying may be executed in accordance with a predetermined program.

Of course, the user may additionally select use of the washing heater 600 while selecting one of the heating executable courses 820. That is, the user may select driving of the washing heater 600 in accordance with a given option for the selected course.

In the heating executable courses 820, driving of the washing heater 600 may be automatically or selectively executed in order to increase the temperature of wash water. That is, it may be possible to increase the temperature of wash water in order to achieve an enhancement in washing efficiency.

Generally, the heating executable courses 820 may involve an option for selection of wash water temperature. Prior to description of the heating executable courses 820, an example of the normal course will be described.

The normal course may be a course in which the temperature of wash water is automatically set to 40° C. In this case, when cold water or tap water is supplied from the external water supply source, an operation of automatically heating wash water to 40° C. may be executed. On the other hand, when 60° C. is selected as a wash water temperature in accordance with a given option for selection of wash water temperature, an operation of heating wash water to 60° C. may be executed. Of course, "cold water" or "tap water" may be selected as a wash water temperature in accordance with the given option for selection of wash water temperature. In this case, wash water heating may be dispensed with.

In this regard, each of the heating executable courses 820 may be a course in which the temperature of wash water is variable to achieve enhanced washing effects. Of course, in this course, the user may select whether or not the washing heater 600 is to be driven.

The plural courses may also include heating-excluding courses 840. That is, the plural courses may include courses in which driving of the washing heater 600 is excluded or limitedly executed. Each of the heating-excluding courses 840 may be a course in which driving of the washing heater 600 is excluded. That is, the heating-excluding courses 840 may be programmed such that they do not include heating.

The heating-excluding courses 840 may include washing courses for functional wear or wool wear having possibility of damage by heat, a quick course for rapid washing, etc. If necessary, accordingly, the washing heater 600 may be automatically set to heat wash water to a temperature of 30 to 40° C. Alternatively, a desired wash water temperature may be selectable within a range of up to 30 or 40° C. Of course, driving of the washing heater 600 may be completely excluded.

The plural courses may include steam courses 830. That is, the plural courses may include courses in which steam is automatically used. In other words, each of the steam courses 830 may be programmed to include steaming. In FIG. 6, an allergy care course 831 and a refreshing course 832 are illustrated as examples of the steam courses 830.

The user may select a desired specific course by rotating a rotary knob 815. When a specific course is selected, the laundry machine automatically executes the selected course, and then completes execution of the selected course. Lamps 816 may be provided at the rotary knob 815. The lamps 816 may correspond to respective courses. Accordingly, the user may easily recognize which course is selected, in accordance with sequential turning on/off of the lamps 816 during rotation of the rotary knob 815.

The plural courses may be intuitionally distinguished from one another by colors printed on the control panel 800 to indicate respective courses. For example, the steam courses 830 are printed by red color in order to enable the user to intuitionally recognize courses of using hot steam.

Here, it may be seen that the plural washing courses in the laundry machine according to the illustrated embodiment are distinguishable from one another in accordance with whether or not the washing heater 600 drives.

The laundry machine may include heating-excluding courses in which driving of the washing heater 600 is completely excluded. The laundry machine may also include courses in which driving of the washing heater 600 is selectable or is automatically included.

The courses including driving of the washing heater 600 may be classified into a heating executable course and a steam course. Hereinafter, differences between the heating executable course and the steam course will be described.

Heating in the heating executable course may be similar to steaming in the steam course. That is, the washing heater 600 may be driven in both the heating operation and the steaming operation. However, there may be a fundamental difference between the heating operation and the steaming operation in terms of the level of wash water during driving of the washing heater 600.

As illustrated in FIG. 4, various water levels may be determined in association with relations among the tub 200, drum 300, and washing heater 600.

In accordance with a variation in water level, there may a water level A, at which the washing heater 600 is completely immersed in water, a water level B, at which wash water reaches the bottom of the drum 300, and a water level C, at which wash water reaches the interior of the drum 300.

In a horizontal-axis laundry machine, washing is carried out through driving of a drum. In spite of such a system, the drum may be driven under the condition that laundry is in a state of being wetted by wash water. In washing, that is, washing of using water, accordingly, wash water may be stored to reach the interior of the drum. Therefore, a preferred water level for washing is at least the water level C.

Meanwhile, when the amount of laundry to be washed is increased, an increased amount of wash water may be supplied. To this end, an increased amount of wash water is supplied for an increased amount of laundry. This means that the level of wash water is increased to be higher than the water level C when the amount of laundry is large.

Basically, a laundry amount determining operation is executed for execution of washing in the laundry machine. That is, when a desired course is selected, and execution of the selected course is begun, the laundry amount determining operation is executed. In accordance with a laundry amount determined in the laundry amount determining operation, the level of wash water for water washing (main washing) is determined. Accordingly, supply of water is executed until the level of wash water supplied reaches the determined wash water level. If necessary, the washing heater 600 is driven after completion of supply of water, to increase the temperature of wash water. Generally, main washing is executed through driving of the drum 300 after completion of supply of water or completion of heating.

In this regard, heating may be an operation of driving the washing heater under the condition that wash water is stored to reach the interior of the drum. Thus, at least a portion of laundry is immersed in heated wash water.

In the illustrated embodiment, however, steaming may be distinguished from heating.

In detail, the level of wash water during steaming may be lower than the level of wash water during heating.

As shown in FIG. 4, the level of wash water during steaming may be lower than at least the water level B, but higher than the water level A. In other words, the level of wash water may be set to prevent laundry received in the drum 300 from coming into contact with heated wash water. The level of wash water may also be set to prevent the washing heater 600 from being exposed to the air.

The level of wash water during steaming may be determined to be always lower than the level of wash water during main washing which is water washing. That is, the level of wash water during steaming may be determined between the water level A and the water level B, whereas the level of wash water during main washing may be determined to be always higher than the water level B.

Due to the above-described differences between the heating operation and the steaming operation, the above-described plural courses may be classified as follows.

First, courses or washing courses, in which steaming is executed, may be referred to as "steam courses". On the other hand, courses or washing courses, in which execution of steaming is excluded, are referred to as "steam-excluding courses". Such steam-excluding courses may be courses in which heating may be included, but steaming is not executed.

The steam courses may include a steam washing course and a refreshing course. An example of the steam washing course may be the allergy care course 831 illustrated in FIG. 6, and another example of the steam washing course may be the refreshing course 832 illustrated in FIG. 6.

The steam washing course may be a course including a steaming operation, and a main washing operation in which water washing is executed using wash water. That is, the steam washing course may be a course in which steaming and main washing are executed during execution of the course.

In the steaming operation, the washing heater 600 may be driven at a water level for steaming. On the other hand, in the main washing operation, the washing heater 600 may be driven at a water level for main washing. That is, a heating operation may be executed for execution of the main washing operation. Of course, the differences between the steaming operation and the heating operation may be associated with levels of wash water, as described above.

The steam courses may include courses including the steaming operation, but excluding the main washing operation. That is, the steam courses may be courses in which the main washing operation at the water level for main washing is not executed during course execution. In detail, such a steam course may include a refreshing course for refreshing laundry, using steam.

Figure 7:
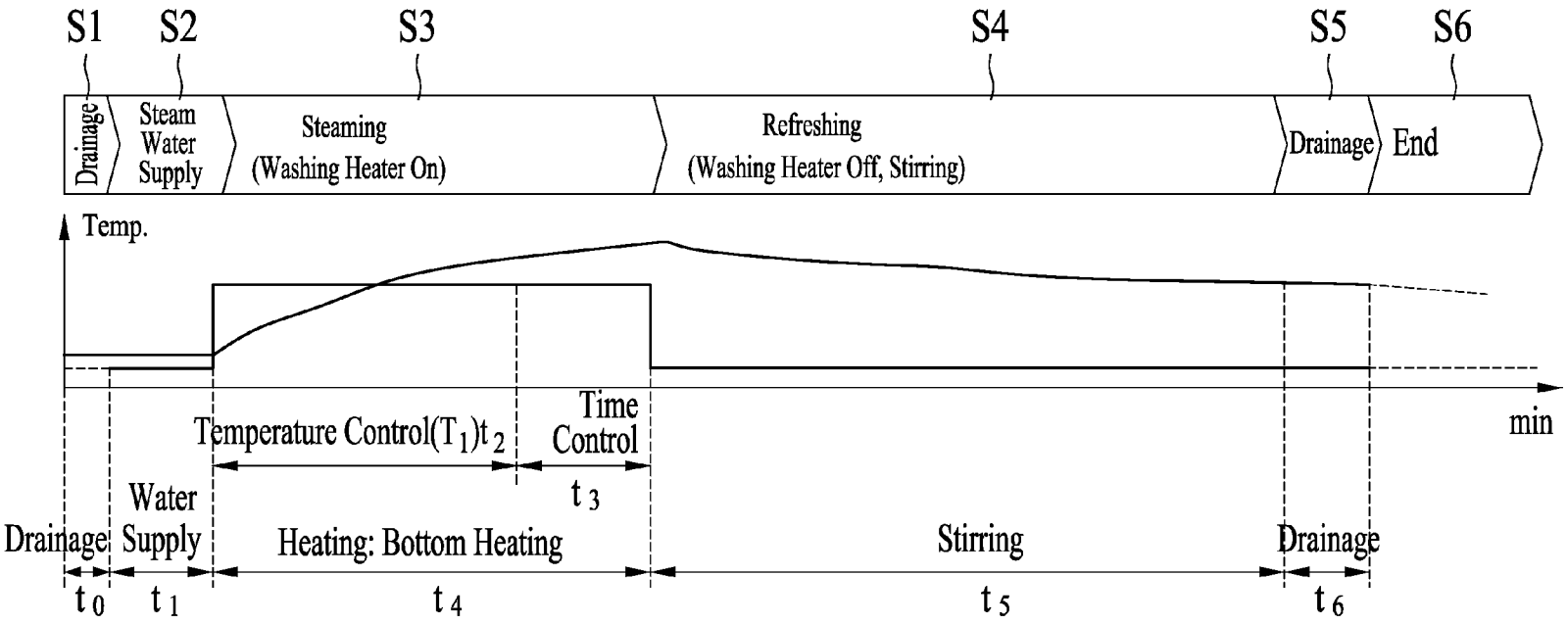
FIG. 7 illustrates a flowchart of a control operation in the laundry machine according to an exemplary embodiment of the present invention, and a graph depicting a temperature variation during the control operation.

Hereinafter, the refreshing course will be described in detail with reference to FIGS. 7 and 8.

One of the plural courses may be selected through the course selector 810, as illustrated in FIG. 6. When the refreshing course is selected through the course selector 810, the selected refreshing course may be executed.

For execution of the refreshing course, wash water may be drained out of the tub 200 for a predetermined time t0 (S1). For execution of the steaming operation, wash water may then be supplied for a predetermined time t1. This operation may be a steam water supply operation S2.

As described above, supply of water in the steam water supply operation S2 is executed such that the level of water supplied reaches the water level for steaming. Accordingly, the steam water supply operation may be executed until the water level sensor 630 senses the water level for steaming. In this regard, the predetermined time t1 in the steam water supply operation S2 may be an allowable water supply period. That is, the predetermined time t1 may be an allowable maximum water supply period. This time may be determined, taking into consideration a variation in water pressure. The predetermined time t1 may be set to about 2 minutes. This means that supply of water may be executed for a maximum of 2 minutes. Typically, supply of water may be ended before 2 minutes elapse because the water level sensor 630 may senses the water level for steaming before 2 minutes elapse.

Supply of water in the steam water supply operation S2 may be executed in a manner different from that of a general washing course. That is, supply of water for execution of the steaming operation in the refreshing course may be executed in a manner different from that of a steam-excluding course.

In detail, when the refreshing course 832 is selected, the controller 805 controls the second water supply valve 161 to be opened in order to introduce wash water into the tub 200 via the second wash water passage 160. In other words, the controller 805 may control supply of water such that wash water is prevented from coming into contact with laundry received in the drum 300.

The refreshing course may be a course of refreshing dry laundry without execution of water washing. For example, the refreshing course may be a course of refreshing laundry such as a shirt that was worn once by the wearer, without water-washing the laundry. In this regard, the refreshing course may be a course of relatively easily and rapidly refreshing laundry through removal of creases or odor without execution of water washing.

Accordingly, it is preferred that laundry be prevented from being wetted by wash water, for execution of the refreshing course. This is because, once laundry is wetted by wash water, it is necessary to execute drying for an additional time. That is, wearing of laundry is possible only after drying through the dryer or natural drying is carried out.

As described above, the refreshing course may be provided to enable wearing of a shirt refreshed just after execution of the refreshing course. Therefore, supply of water through the second wash water passage 160 is very preferable.

Meanwhile, the second wash water passage 160 may be a passage irrespective of the detergent box 152. That is, clean water such as tap water may always be supplied through the second wash water passage 160. On the other hand, the first wash water passage 160 is connected with the detergent box 153. For this reason, sediments of detergent or the like may remain in the first wash water passage 160. However, such detergent sediments do not cause any serious problems in association with water washing. This is because water washing is carried out, using a relatively great amount of wash water.

However, the second wash water passage 160 is a passage irrespective of detergent sediments or the like. Accordingly, detergent sediments or the like do not enter the interior of the tub 200.

Theoretically, it is difficult to completely prevent laundry from coming into contact with wash water introduced through the second wash water passage 160. This is because it is impossible to avoid a possibility that small droplets formed in accordance with striking of wash water against the tub 200 may be introduced into the drum 300.

In this case, it is very undesirable that detergent sediments are introduced into laundry during the refreshing course in which no water washing is carried out. This is because detergent sediments may remain in laundry after completion of the refreshing course.

In this regard, it is preferred that supply of wash water in the refreshing course be executed through the second wash water passage 160, as described above. In this case, it may be possible to supply only clean water to the interior of the tub 200. Accordingly, it may be possible to prevent contaminants such as detergent sediments from being transferred to laundry.

After completion of the steam water supply operation S2, a steaming operation S3 may be executed.

The steaming operation S3 may be an operation of generating steam by driving the washing heater 600. Alternatively, the steaming operation S3 may be an operation of simultaneously executing generation of steam and transferring of steam to the interior of the drum 300.

Driving of the washing heater 600 during the steaming operation S3 may be intermittently executed. In spite of such a driving method, a great amount of energy may be consumed for increase in water temperature and vaporization of water. For this reason, it is preferred that the washing heater 600 be driven in a continuous manner. In accordance with such a driving method, steam may be continuously generated during the steaming operation S3.

The time taken for the steaming operation S3 is variable. This is because the time taken for the steaming operation S3 may be varied in accordance with the amount of wash water for generation of steam (associated with water level), the capacity of the washing heater 600, and a predetermined heating temperature of the washing heater 600.

In addition, overheating of the washing heater 600 in the steaming operation S3 should be prevented. This means that it is necessary to prevent the washing heater 600 from being driven in a state of being exposed to the air.

In accordance with the illustrated embodiment, therefore, it is preferred that the driving time of the washing heater 600 during the steaming operation S3 be controlled to be variable. That is, it is preferred that the period of time that driving of the washing heater 600 is continuously executed from a time when driving of the washing heater 600 starts until driving of the washing heater 600 is stopped be controlled to be variable. In addition, an allowable maximum value of the period may be predetermined. Such an allowable maximum value may be determined, taking into consideration the capacity of the washing heater 600 and the amount of wash water at the water level for steaming.

The steaming operation S3 may include a temperature control operation and a time control operation in association with control of the washing heater 600. The sum of a time t2 taken for the temperature control operation and a time t3 taken for the time control operation may be the time taken for the steaming operation S3, namely, a time t4.

Here, the time control operation may be an operation of continuously driving the washing heater 600 for a predetermined time. The time t3 may be the predetermined time.

Of course, the time t3 of the time control operation may be predetermined to be an allowable maximum time. That is, the time t3 may be predetermined to be an allowable maximum time while being variable in accordance with the time t2 of the temperature control operation. Accordingly, the time t4 taken for the steaming operation S3 may be substantially variable by the times t2 and t3.

In detail, the temperature control operation may be an operation of continuously driving the washing heater 600 until the heating temperature of wash water reaches a target temperature, namely, a predetermined temperature T1. In this regard, the target temperature may be a fixed value, but the time taken for the heating temperature to reach the target temperature may be variable. This is because there are causes such as a deviation in the amount of wash water, a deviation in the voltage applied to the washing heater 600, a deviation in the initial temperature of wash water, and differences of articles of laundry.

The predetermined temperature T1 may be set to be lower than the boiling point of water, namely, 100° C. This is because the time control operation follows after the temperature control operation, that is, the washing heater 600 is continuously driven in the time control operation, even after the temperature control operation. In other words, the predetermined temperature T1 is set as described above in order to secure a sufficient steam generation time while preventing wash water from overheating.

Figure 8:
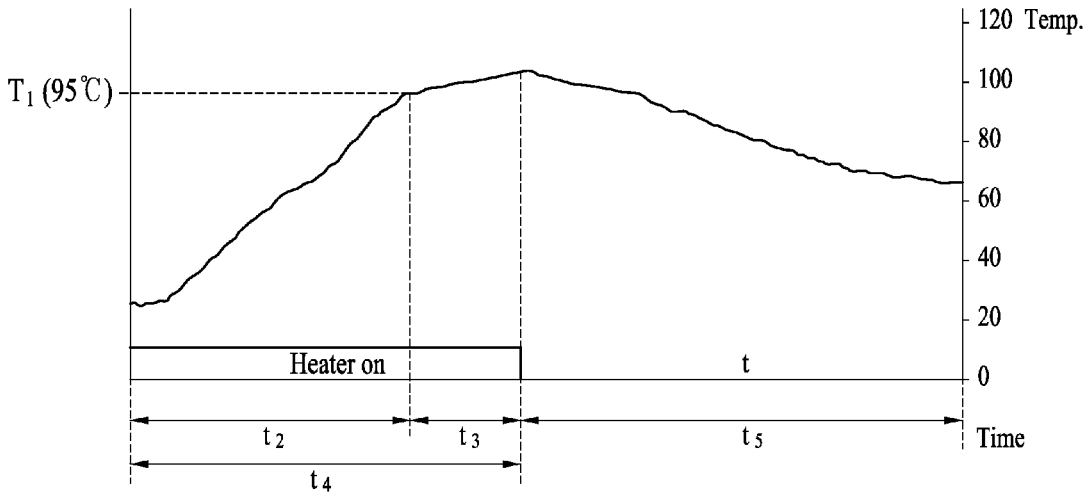
FIG. 8 is a graph depicting a temperature variation in a steaming operation illustrated in FIG. 7.

After driving of the washing heater 600 starts in the steaming operation S3, the temperature of wash water is gradually increased, as shown in FIG. 8. When the temperature of wash water approaches the boiling point of water, namely, 100° C., the temperature increase gradient of wash water may be varied.

After experiments of operating the laundry machine in a heating environment, it may be seen that the temperature increase gradient of wash water becomes gentle at about 95° C. This may be because a large portion of heat to heat wash water is used as heat of vaporization.

In this regard, in the illustrated embodiment, the predetermined temperature T1 in the temperature control operation may be set to be about 95° C. The temperature control operation may be continued until the temperature sensor 610 senses the predetermined temperature T1. Time t2 may be the time required until the predetermined temperature T1 is reached. Accordingly, the time t2 may be a variable time.

The predetermined temperature T1 may be sensed by the temperature sensor 610 which is disposed in the vicinity of the washing heater 600. That is, the temperature sensor 610 may be provided to sense a temperature at a position very close to an area where heat is generated. In FIG. 4, an example of the temperature sensor 610 disposed at one side of the washing heater 600 is illustrated.

Thus, the temperature sensor 610 does not directly sense the temperature of the washing heater 600, but very rapidly senses the temperature of wash water heated through the washing heater 600.

Meanwhile, the time control operation follows the temperature control operation. Of course, the washing heater 600 is continuously driven during the time control operation. In other words, driving of the washing heater 600 is maintained for the predetermined time t3 after completion of the temperature control operation. Of course, the predetermined time t3 may be a fixed value.

The predetermined time t3 may be appropriately set, taking into consideration overheating of wash water, overheating of the washing heater 600, amount of wash water, and steam generation time.

The inventors of the present invention experimentally found that it is desirable to predetermine the time taken for the time control operation to be about 2 minutes and 30 seconds. When the time control operation is executed as described above, it may be seen that the maximum heating temperature of wash water is controlled to be lower than 103° C.

Of course, the time taken for the time control operation may be varied in accordance with a relation thereof with the predetermined temperature T1 in the temperature control operation. This is because it is desirable to increase the time t2 when the predetermined temperature T1 decreases.

Thus, it may be possible to secure prevention of overheating and a sufficient steam generation time as the steaming operation S3 is executed through the temperature control operation and the time control operation successively following the temperature control operation.

Hereinafter, examples of the temperature control operation and time control operation in the steaming operation will be described.

The temperature control operation may be continued for 7 minutes. Here, "7 minutes" may be a variable time. Subsequently, the time control operation may be continued for a fixed time of 2 minutes and 30 seconds. Accordingly, the steaming operation may be executed for 9 minutes and 30 seconds.

Meanwhile, the temperature control operation may be continued for 8 minutes. Subsequently, the time control operation may be continued. In this case, however, the time control operation may be continued for 2 minutes, in place of the fixed time of 2 minutes and 30 seconds. Thus, the time control operation may be variably controlled in accordance with the temperature control operation. An allowable maximum value of the time control operation may be fixed. For example, the allowable maximum value may be 2 minutes and 30 seconds.

In accordance with determination of the allowable maximum value of the time taken for the time control operation, the allowable maximum value of the execution period of the steaming operation may be determined. For example, the allowable maximum value of the execution period of the steaming operation may be 10 minutes. When the temperature control operation is executed only for 7 minutes, as described above, the steaming operation may be executed for 9 minutes and 30 seconds.

Since temperature control and time control are sequentially executed, it may be possible to prevent the washing heater or wash water from overheating. It may also be possible to secure a sufficient steam generation time. Since the allowable maximum value of the time taken for the time control period is predetermined, the allowable maximum value of the execution period of the steaming operation is also predetermined. Accordingly, there is no occasion that the time taken for the steaming operation is no longer increased.

For example, if time control is not executed, there may be a possibility that the time taken for the steaming operation may be excessively increased, in a particular environment. For example, extreme environments such as an excessive amount of wash water, a very low initial temperature of wash water, a very low external voltage, a very cold external environment, and an excessive amount of laundry may be assumed. In such cases, the time taken for the steaming operation may be 10 minutes or more.

As described above, the refreshing course may be a course for refreshing laundry for a short period of time. Accordingly, it is preferred that the time taken for the refreshing course be predetermined. In this regard, it is undesirable to execute the refreshing course for a time longer than the predetermined time, even in an extreme environment.

For this reason, the allowable maximum value of the time taken for the steaming operation may be predetermined. The time taken for the time control operation may be varied, taking into consideration the allowable maximum value of the time taken for the steaming operation and the time taken for the temperature control operation. Of course, the allowable maximum value of the time taken for the time control operation may also be predetermined.

If necessary, the time control operation may be dispensed with. Alternatively, the time control operation may be executed only for a time much shorter than the allowable maximum value of the time taken for the time control operation. Of course, the time control operation may be executed for the allowable maximum time thereof.

It may be possible to control the drum 300 to execute tumbling driving during the steaming operation S3. That is, a stirring operation may be executed during the steaming operation S3.

Such tumbling driving is adapted to effectively transfer steam to laundry. The tumbling driving may also be adapted to create a steam environment within the tub 200 as well as the drum 300. Accordingly, steam may be uniformly spread within the tub 200 and drum 300 without being locally concentrated, through tumbling driving. Similarly, steam is supplied throughout the entirety of laundry without being locally supplied to the laundry.

Through the above-described steaming operation S3, laundry is exposed to a hot and humid environment. Odor molecules may be removed from the laundry in the hot and humid environment. Of course, in the steaming operation, it may be possible to supply moisture throughout a very wide area, as compared to a conventional case in which the same amount of water as that of the steaming operation S3 is used. This is because moisture in a steam state is supplied to laundry, in place of moisture in a water state.

When the steaming operation S3 is completed, a refreshing operation S4 may be executed. That is, the steaming operation S3 and refreshing operation S4 may be sequentially executed. The controller 820 may control the steaming operation S3 and refreshing operation S4 to be sequentially executed, in accordance with a predetermined program.

The refreshing operation S4 may be an operation of increasing the content of moisture in laundry, using steam. The refreshing operation S4 may also be an operation of uniformly supplying steam to laundry in a steam environment.

The refreshing operation S4 may also be an operation of gradually lowering the internal temperature of the drum 300 or tub 200. In this regard, the drum 300 may also be driven during the refreshing operation S4, similarly to the steaming operation S3.

Generally, "tumbling driving" means driving of a drum to raise laundry from a bottom of the drum, and then to drop the raised laundry. For this reason, the laundry may include folded portions. Of course, the laundry may have variable exposure surfaces because it tumbles in accordance with the tumbling driving.

Supply of steam in the steaming operation S3 is not carried out in such a manner that steam is directly injected onto laundry under high pressure. Supply of steam in the steaming operation S3 is carried out in such a manner that laundry absorbs steam in a steam environment. Therefore, it is desirable to uniformly and maximally expose surfaces of laundry to a steam environment.

In addition, for removal of creases, applying certain tension to laundry may be more effective. In other words, it may be possible to more effectively remove creases by supplying moisture to a creased laundry portion while tensing the creased laundry portion at opposite sides thereof.

Therefore, drum driving in the refreshing operation S4 may include spin driving in order to achieve more effective and uniform supply of steam to laundry and more effective removal of creases from laundry.

In spin driving, the revolutions per minute (RPM) of the drum 300 is relatively high, as compared to that in tumbling driving. That is, "spin driving" means a driving operation to rotate the drum 300 such that laundry overcomes gravity. Generally, such spin driving may be realized at about 80 rpm.

In spin driving, laundry is rotated integrally with the drum 300 while in contact with an inner surface of the drum 300. Accordingly, tension may be applied to laundry in accordance with rotation of the drum 300. Laundry may also come into contact with steam present in the tub 200 through the through holes 310. It may also be possible to more effectively supply steam to laundry by generating flow of steam in the drum 300.

That is, it may be possible to increase the steam contact area of laundry because the laundry may spread through spin driving. It may also be possible to obtain enhanced crease removal effects because tension may be applied to laundry.

Meanwhile, the inventors found that it is more preferable for spin driving to be executed together with tumbling driving during the refreshing operation S4. This may be because tumbling driving is driving to tumble laundry or to change exposure surfaces of the laundry through stirring of the laundry. That is, this may be because tumbling driving is driving to expose the entire outer surface of laundry to a steam environment, rather than to expose particular portions of laundry to the steam environment.

In this regard, it may be assumed that only the tumbling driving is executed during the refreshing operation S4. However, it may be possible to achieve an increase in moisture content and an enhancement in crease removal effects, through the spin driving. In other words, it may be possible to achieve an increase in moisture content, that is, to enable laundry to absorb a relatively large amount of moisture, in accordance with addition of spin driving, as compared to the case in which only the tumbling driving is executed. It was also be found that an enhancement in crease removal effects is achieved.

Therefore, an operation of executing tumbling driving of the drum 300 and an operation of executing spin driving of the drum 300 may be alternately executed during the refreshing operation S4. That is, a tumbling driving operation is executed for a predetermined period, and a spin driving operation is then executed for a predetermined period. Each of the tumbling driving operation and spin driving operation may be executed multiple times. In other words, a drum driving cycle including the tumbling driving operation and spin driving operation may be repeated multiple times.

In order to easily realize various control of drum driving as described above, the driving unit to drive the drum 300 may be a direct connection type driving unit different from that of FIG. 4. Such a direct connection type driving unit is well known in the technical field and, as such, no detailed description thereof will be given.

In detail, the time taken for the tumbling driving operation may be longer than the time taken for the spin driving operation. For example, the total time taken for repeated tumbling driving operations may be about 10 times as long as the total time taken for repeated spin driving operations. This is because, if the spin driving time is excessively increased, crease formation possibility may be increased.

Therefore, the refreshing operation S4 may be executed, starting from tumbling driving and ending by tumbling driving. Spin driving may be executed for a relatively short time between successive tumbling driving operations.

As described above, spin driving may be executed multiple times. In this case, spin driving may exhibit different characteristics in accordance with different execution points of time. First, spin driving executed in an early stage of the refreshing operation S4 may be adapted to achieve an increase in moisture content. Of course, such an increase in moisture content may be to achieve removal of creases. This is because spin driving in an early stage of the refreshing operation S4 is executed in a hot and humid environment.

However, the temperature and humidity of the environment are inevitably gradually lowered as the refreshing operation S4 proceeds toward a last stage thereof. This is because the interior of the tub 200 is incompletely sealed from the outside thereof. Accordingly, the amount of moisture in the interiors of the drum 300 and tub 200 is gradually reduced as the refreshing operation S4 proceeds toward a last stage thereof. This means a reduction in the moisture content of laundry.

In this regard, spin driving in stages toward the last stage of the refreshing operation S4 may be executed to reduce the moisture content of laundry. That is, this spin driving may be spin driving to remove moisture from laundry through generation of flow of air in the drum 300 or tub 200.

Thus, a subsequent drying procedure following the refreshing course may be substantially dispensed with. In other words, laundry such as a shirt may be worn by the wearer just after completion of the refreshing course. In this regard, the refreshing course may be very effectively utilized.

Meanwhile, the refreshing course 832 is considerably different from a general water washing course in terms of characteristics. That is, the refreshing course 832 is a course to rapidly refresh dry laundry under the condition that the laundry is not wetted by water.

Accordingly, spin driving in the refreshing operation S4 may be very effective in terms of reliability of the laundry machine or user satisfaction. That is, in accordance with repetition of tumbling driving included in general washing and spin driving, the user may visually and intuitionally recognize execution of the refreshing operation S4. This is because the user may see laundry moving within the drum 300 from the outside of the drum 300 through a transparent window provided at the door 400.

The refreshing operation S4 may be executed for a predetermined time t5. As described above, the total time of the refreshing course may be predetermined. This is because the user may desire to wear laundry just after completion of the refreshing course. Therefore, the time taken for the refreshing course S4 may be predetermined.

Based on the predetermined time t5, it may be possible to determine the number of tumbling driving operations, the number of spin driving operations, the time taken for each driving operation, the time difference between each tumbling driving operation and each spin driving operation, etc.

As the refreshing operation S4 proceeds, the internal temperature of the drum 300 or the temperature of wash water may be gradually decreased. Accordingly, when the refreshing operation S4 is completed, the refreshing course may be ended (S6) after execution of a drainage operation S5. The time taken for the drainage operation S5, t6, may also be predetermined.

As described above, the refreshing course may be completed without additional supply of water after completion of the refreshing operation S4. The refreshing operation S4 may be executed for about 15 to 20 minutes.

In this case, accordingly, the internal temperature of the drum 300 or the temperature of laundry after the refreshing course may be high. For this reason, when the door 400 is opened after completion of the refreshing course, the user may have inconvenience due to hot air. To this end, a cooling procedure for decreasing the internal temperature of the tub 200 or drum 300 may be needed. Of course, the cooling procedure needs not be executed all of the time. This is because the cooling procedure may not be needed in accordance with the amount of laundry or the maximum temperature of wash water.

In accordance with the illustrated embodiment, a cooling operation may be executed after completion of the refreshing operation S4, if necessary.

That is, a cooling operation may be executed between the refreshing operation S4 and the drainage operation S5. The cooling operation may be an operation of forcibly decreasing the temperature of wash water and the temperature of the internal atmosphere of the laundry machine, using cold water.

In detail, it may be possible to sense the temperature of wash water through the temperature sensor 610 after completion of the refreshing operation S4. Since the temperature sensor 610 may be disposed in the vicinity of the washing heater 600, it may be possible to sense a maximum internal temperature of the tub 200. Accordingly, it may be possible to execute an operation of comparing the temperature sensed through the temperature sensor 610 with a predetermined temperature T2.

The predetermined temperature T2 may be, for example, about 60° C.

As described above, the drainage operation S5 may be executed without execution of a separate cooling procedure when the sensed temperature is lower than the predetermined temperature T2. However, when the sensed temperature is equal to or higher than the predetermined temperature T2, the cooling operation may be executed.

Figure 9:
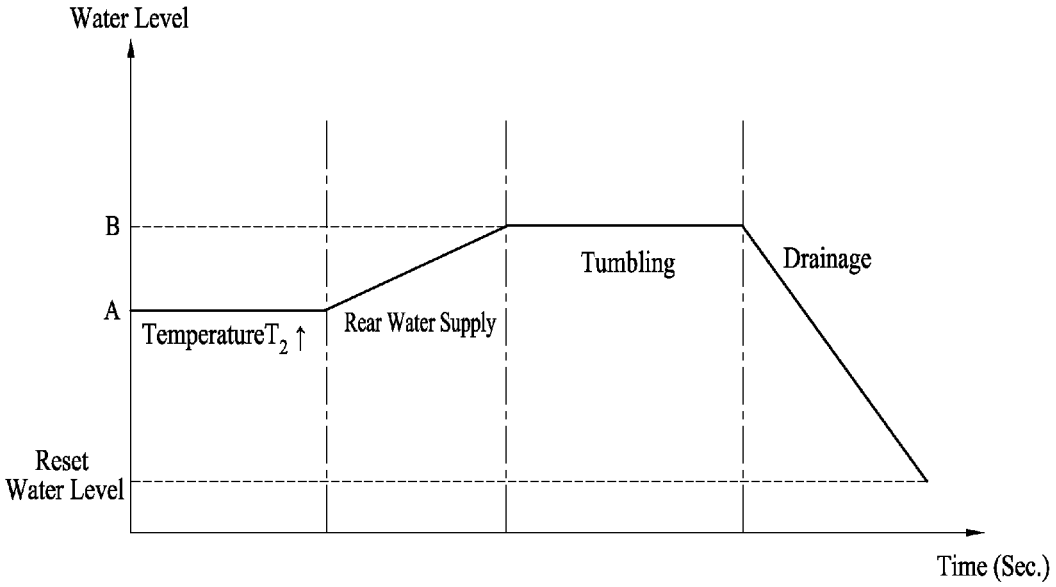
FIG. 9 is a graph depicting a temperature variation in a cooling operation selectively executable after completion of a refreshing operation illustrated in FIG. 7.

As shown in FIG. 9, a temperature sensing operation may be executed for a very short time. During the temperature sensing operation, there may be no variation in water level. The water level during the temperature sensing operation may be substantially lower than the water level for steaming. That is, the water level during the temperature sensing operation may be lower than the water level A.

If the sensed temperature is higher than the predetermined temperature T2, cold water may be supplied from the external water supply source. That is, re-supply of water may be executed.

In this case, cold water may be supplied via the second wash water passage, similarly to supply of water in the steaming operation. Re-supply of water may be carried out until the level of water re-supplied reaches the water level for steaming. For example, the level of re-supplied water may be the water level A which is an example of the water level for steaming. However, the level of re-supplied water may be higher than the water level for steaming in order to achieve more rapid cooling. That is, water may be additionally supplied up to the water level B approaching the lowermost portion or bottom surface of the drum 300.

That is, the level of re-supplied water may be higher than the water level for steaming. The level of re-supplied water may also be lower than the water level for main washing. Accordingly, laundry is not wetted by wash water even when water is supplied up to the above-described re-supply water level. This is because wash water is not re-heated.

On the other hand, the water level for steaming may be lower than the water level B, taking into consideration generation of air bubbles due to heating, because wash water is heated at the water level for steaming.

By virtue of the difference between the water level for steaming and the re-supply water level, an increased amount of wash water may be supplied without wetting laundry. Accordingly, it may be possible to more rapidly decrease the internal temperature of the drum 300.

In this connection, it may be seen that the position and water supply direction of the rear water supply port 163 are important, as described above. Re-supply of water or additional supply or water may be executed to rapidly decrease the internal temperatures of the tub 200 and drum 300, rather than to simply decrease the temperature of wash water collected in the lower portion of the tub 200. Therefore, it is preferred that the heat exchange area of additionally-supplied wash water be maximized.

The rear water supply port 163 may be arranged to allow wash water supplied through the rear water supply port 163 to flow downwardly along the rear surface of the tub 200. In this case, the wash water supplied through the rear water supply port 163 may exchange heat with a large area of the tub 200. Accordingly, more rapid cooling may be achieved.

After completion of the additional supply of water, tumbling driving may be executed for, for example, 2 to 3 minutes. Through the tumbling driving, flow of air is generated within the tub 200 and drum 300 and, as such, rapid cooling may be achieved.

After completion of the tumbling driving, drainage may be executed. Thus, execution of the refreshing course may be completed.

Heretofore, the refreshing course as an example of the steam courses has been described in detail.

Hereinafter, the steam washing course will be described in detail.

In FIG. 6, the allergy care course 831 is illustrated as an example of the steam washing courses. The allergy care course 831 may be a course in which a steaming operation is executed together with water washing. Supply of water for main washing, in which water washing is executed, that is, supply of water up to the water level for main washing, may be executed via the first wash water passage 150. In other words, it may be possible to enhance washing effects by wetting laundry by wash water and detergent from an early stage of the course.

The steaming operation in the allergy care course 831 may be executed before main washing. For the steaming operation, supply of water up to the water level for steaming may be executed. Additional supply of water may be executed after completion of the steaming operation. Here, the additional supply of water may mean supply of water up to the water level for main washing.

Preferably, supply of water for execution of the steaming operation in the allergy care course 831 is preferably executed via the second wash water passage 160, similarly to the refreshing course. However, it is more preferred that supply of water be executed via the first wash water passage 150 because the allergy care course 831 includes water washing.

That is, wash water and detergent may be supplied up to the water level for steaming via the first wash water passage 150. Accordingly, wash water and detergent may be supplied from an initial stage of the allergy care course 831. Thereafter, a steaming operation may be executed to supply steam to laundry.

In the allergy care course 831, the steaming operation may be executed under the condition that at least a portion of laundry has been wetted by wash water and detergent. Accordingly, soaking of laundry and contaminants and soaking of detergent may be more actively achieved through the steaming operation.

Therefore, it is preferred that wash water always be supplied via the first wash water passage 150 in the steam washing course in which water washing is executed. On the other hand, it is preferred that wash water always be supplied via the second wash water passage 160 in the steam course in which water washing is excluded.

In other words, the passage to supply wash water may be changed in accordance with whether water washing is executed, even in a course in which steaming is executed. In addition, the passage to supply wash water may be changed in accordance with selected courses, even when wash water is supplied for execution of the same steaming operation in the selected courses.

In detail, supply of water for main washing using water may be executed via the first wash water passage 150, irrespective of selected courses. On the other hand, supply of water for execution of steaming may always be executed via the second wash water passage 160. Alternatively, supply of water for execution of steaming may be executed via the first wash water passage in accordance with selected courses.

For example, in a course including a water washing operation and a steaming operation, supply of water for execution of the steaming operation may be executed via the first wash water passage 150. In a course including a steaming operation while excluding a water washing operation, however, supply of water for execution of the steaming operation may be executed via the second wash water passage 160.

Accordingly, the controller 805 of the laundry machine according to the illustrated embodiment may perform a control operation to selectively open the first wash water passage 150 or the second wash water passage 160 in accordance with a course selected through the course selector 810. Selection of a specific passage may be executed by selectively opening the water supply valve 151 or 161.

In detail, in a water washing course (including a steam washing course, a heating executable course, and a heating-excluding course) in which wash water is supplied up to the water level for main washing, for execution of water washing, supply of wash water may be controlled to be always executed via the first wash water passage 150. In this case, accordingly, wash water and detergent are supplied to laundry from an initial stage of the course and, as such, rapid wetting of laundry and enhanced washing effects may be expected. Meanwhile, the water level for main washing may always be higher than the water level for steaming, irrespective of selected courses and amount of laundry.

As apparent from the above description, in accordance with an aspect of the present invention, it may be possible to provide a laundry machine capable of supplying wash water at an optimal position in accordance with a selected course, through control of varying the supply position of wash water in accordance with a selected course, and a control method of the same.

In accordance with another aspect of the present invention, it may be possible to provide a laundry machine capable of achieving refresh, using steam, while obtaining enhanced washing effects, using steam, and a control method of the same.

In accordance with another aspect of the present invention, it may be possible to provide a laundry machine capable of achieving effective generation and supply of steam, using a washing heater, and a control method of the same.

In accordance with another aspect of the present invention, it may be possible to provide a laundry machine capable of executing a wash water heating operation, separately from a steam operation, using a washing heater, and a control method of the same.

In accordance with another aspect of the present invention, it may be possible to provide a laundry machine capable of more effectively achieving forced cooling through supply of wash water, and a control method of the same.

In accordance with another aspect of the present invention, it may be possible to provide a laundry machine capable of remarkably enhancing crease removal effects and odor removal effects, and a control method of the same.

In accordance with another aspect of the present invention, it may be possible to provide a laundry machine capable of achieving enhanced safety and enhance reliability, and a control method of the same.

In accordance with another aspect of the present invention, it may be possible to provide a laundry machine capable of realizing a refreshing performance enabling wearing of garments just after refreshing thereof without requiring a separate drying procedure, and a control method of the same.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a tub to store wash water;

a drum rotatably installed in the tub, to receive laundry, the drum having a plurality of through holes;

a washing heater provided at a lower inside portion of the tub, to heat wash water and to generate steam inside the tub, the steam being supplied into the drum via the through holes;

a first wash water passage for supplying the wash water from an external water supply source to the drum via a detergent box;

a second wash water passage for supplying the wash water from the external water supply source to an interior of the tub while preventing the wash water from passing through the drum, wherein the second wash water passage including a rear water supply port formed at a rear top portion of the tub in rear of the rearmost portion of the drum;

a temperature sensor provided at the lower inside portion of the tub in proximity to the washing heater and configured to sense an indirect heating temperature of the washing heater; and a controller for selectively opening the first wash water passage or the second wash water passage in accordance with a selected washing course, the controller being configured to control the driving of the washing heater for steam generation, wherein the washing heater is controlled to be driven based on a temperature control operation to generate steam until the temperature sensor senses a predetermined temperature, T1, for a time, t2, and then the washing heater is controlled to be sequentially driven based on a time control operation to generate steam for a predetermined time, t3, after completion of the temperature control operation.

2. The laundry machine according to claim 1, further comprising: a first water supply valve for opening or closing the first wash water passage, and a second water supply valve for opening or closing the second wash water passage, wherein the first water supply valve and the second water supply valve are separate from each other.

3. The laundry machine according to claim 1, wherein a predetermined water level for generation of steam is a water level which is lower than a bottom of the drum.

4. The laundry machine according to claim 1, further comprising a course selector to select one of a plurality of washing courses.

5. The laundry machine according to claim 4, wherein the plurality of washing courses comprise at least one steam course in which a steaming operation is executed, and/or at least one steam-excluding course in which execution of the steaming operation is excluded.

6. The laundry machine according to claim 5, wherein the controller executes a control operation to supply the wash water to the interior of the tub via the first wash water passage when the steam-excluding course is selected; and/or wherein the controller executes a control operation to supply the wash water to the interior of the tub via the second wash water passage when the steam course is selected.

7. The laundry machine according to claim 5, wherein the steam course comprises at least one of: a steam washing course comprising a steaming operation and a main washing operation for executing water washing by the wash water; and a refreshing course comprising a steaming operation while excluding the main washing operation, to refresh the laundry by steam.

8. The laundry machine according to claim 7, wherein the controller executes a control operation to supply the wash water to the interior of the tub via the second wash water passage when the refreshing course is selected.

9. The laundry machine according to claim 7, wherein the controller executes a control operation to supply the wash water to an interior of the drum via the first wash water passage for execution of the steaming operation of the steam washing course.

10. The laundry machine according to claim 4, wherein the plurality of washing courses includes a refreshing course, the refreshing course comprising: a steaming operation, which is executed to supply steam to the interior of the drum by heating wash water after completion of supply of wash water; and a refreshing operation of refreshing the laundry by driving the drum after completion of the steaming operation, wherein the controller controls the steaming operation and the refreshing operation to be sequentially executed when the refreshing course is selected.

11. The laundry machine according to claim 10, wherein the controller controls the refreshing operation to alternately execute a tumbling driving operation to tumble the laundry within the drum in accordance with rotation of the drum and a spin driving operation to rotate the laundry within the drum in close contact with an inner surface of the drum, together with the drum, in accordance with high-speed rotation of the drum.

12. The laundry machine according to claim 10, wherein the controller executes a control operation to supply the wash water to the interior of the tub up to a predetermined water level for re-supply of water via the second wash water passage after completion of the refreshing operation.

13. The laundry machine according to claim 12, wherein the water level for re-supply of water is higher than a water level for generation of steam, but lower than a bottom of the drum.

14. The laundry machine according to claim 1, wherein the driving of the washing heater in the steaming operation is continuously executed for a variable time, and an allowable maximum value of the variable time is predetermined, taking into consideration a capacity of the washing heater and an amount of the wash water at the water level for generation of steam.

15. The laundry machine according to claim 1, wherein the first wash water passage supplies the wash water from the external water supply source to the drum via a detergent box.

16. The laundry machine according to claim 1, further comprising a valve selectively opening or closing the first wash water passage and/or the second wash water passage.

17. The laundry machine according to claim 1, further comprising: a first water supply valve for opening or closing the first wash water passage; and a second water supply valve for opening or closing the second wash water passage.

18. The laundry machine according to claim 17, wherein the first water supply valve and the second water supply valve are separate from each other.

* * * * *